United States Patent [19]

Sakai et al.

[11] Patent Number: 4,764,649

[45] Date of Patent: Aug. 16, 1988

[54] SNAP SWITCH WITH A SEPARATE LEAF SPRING BIASING MEMBER

[75] Inventors: Masatoshi Sakai, Tsu; Takeshi Nishii, Matsuzaka, both of Japan

[73] Assignee: Matsushita Electric Works, Ltd., Osaka, Japan

[21] Appl. No.: 924,757

[22] Filed: Oct. 30, 1986

[30] Foreign Application Priority Data

Dec. 13, 1985 [JP] Japan ..... 60-192420[U]

[51] Int. Cl.[4] ..... H01H 13/38

[52] U.S. Cl. ..... 200/67 D; 200/67 DB; 200/340

[58] Field of Search ..... 200/67 DB, 67 D, 340, 200/153 V

[56] References Cited

U.S. PATENT DOCUMENTS

| | | | |
|---|---|---|---|
| 2,468,512 | 4/1949 | Riche | 200/67 D |
| 3,033,953 | 5/1962 | Schwerke | 200/67 D |
| 3,056,866 | 10/1962 | Karleen | 200/67 D |
| 3,187,132 | 6/1965 | Dennison | 200/67 D |
| 3,244,848 | 4/1966 | Chapin et al. | 200/67 D |
| 3,290,464 | 12/1966 | Finnegan et al. | 200/67 D |
| 4,348,563 | 9/1982 | Henville | 200/67 D |

FOREIGN PATENT DOCUMENTS

| | | | |
|---|---|---|---|
| 503504 | 4/1939 | United Kingdom | 200/67 D |
| 640097 | 7/1950 | United Kingdom | 200/67 D |

*Primary Examiner*—Renee S. Luebke

*Attorney, Agent, or Firm*—Burns, Doane, Swecker & Mathis

[57] ABSTRACT

An electrical switch includes a movable contactor which is actuated by a push button to engage a movable contact with a normally-open contact. A spring yieldably resists depression of the push button and normally maintains a clearance between the push button and the contactor. The spring is superimposed relative to the connector and engages the latter to act as a heat conducting fin. A free end of the spring slides in a notch of the push button. In one embodiment, the spring produces a varying rate of resistance to depression of the button. In another embodiment, the spring urges the connector to its normal position in response to release of the button.

9 Claims, 2 Drawing Sheets

Fig. 1
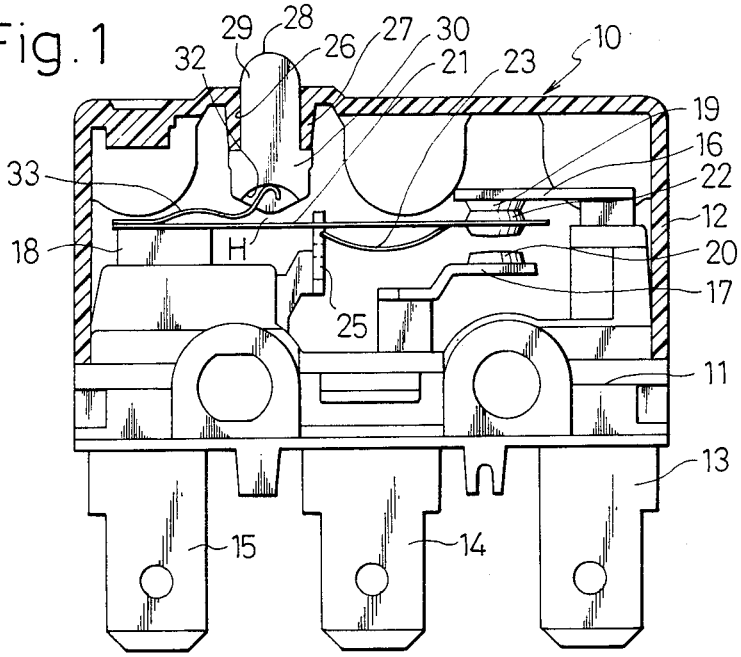
Fig. 2
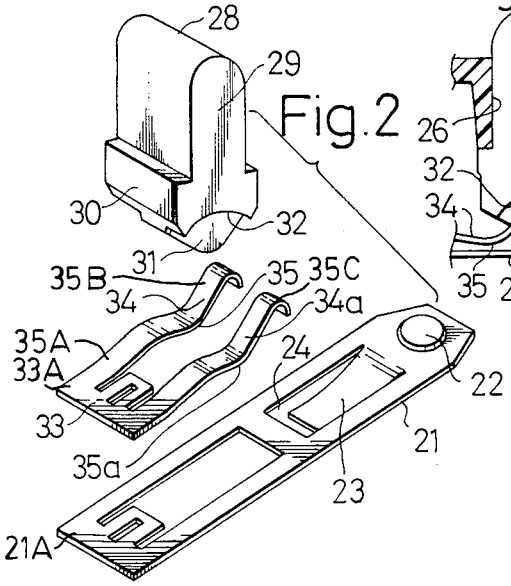
Fig. 3a
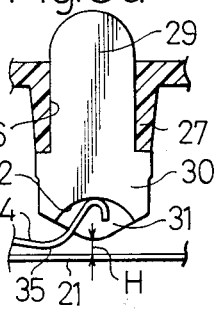
Fig. 3b
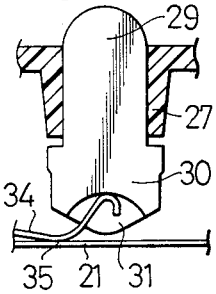
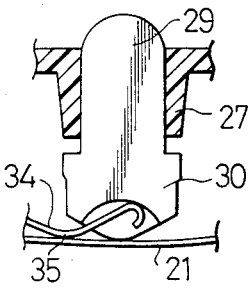
Fig. 3c Fig. 4
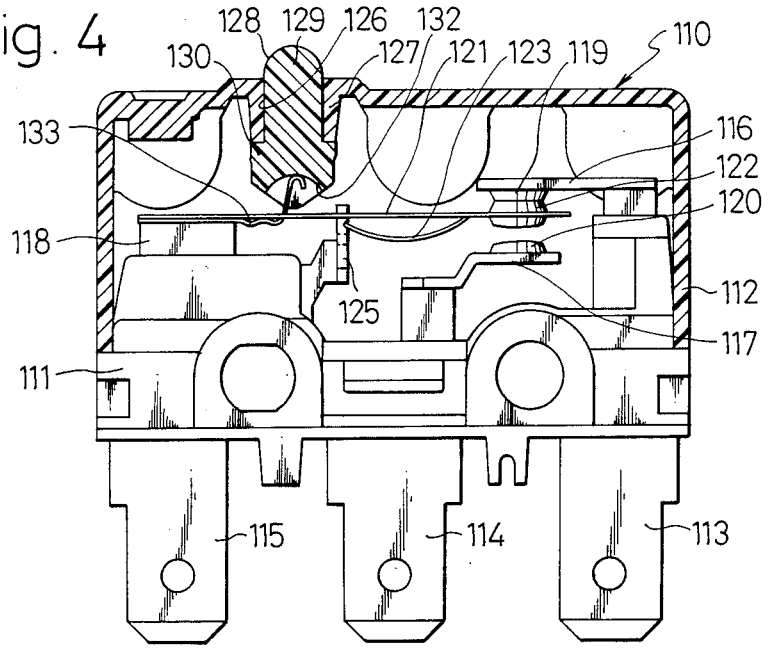
Fig. 5
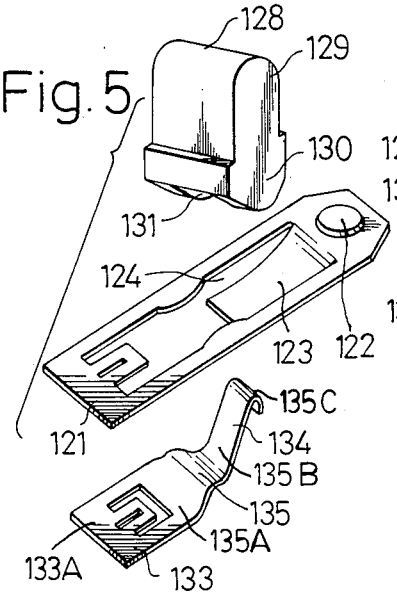
Fig.6a
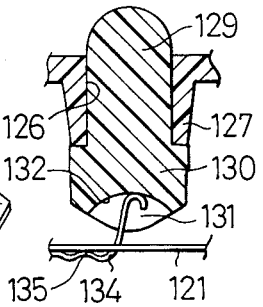
Fig.6b
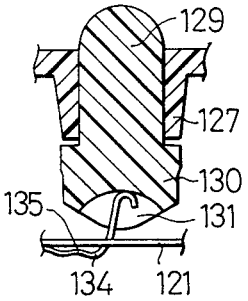
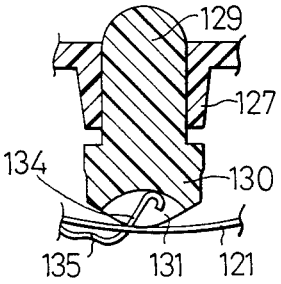
Fig.6c

SNAP SWITCH WITH A SEPARATE LEAF SPRING BIASING MEMBER

TECHNICAL BACKGROUND OF THE INVENTION

This invention relates to small switches and, more particularly, to a small switch in which actuation of a push-button enables switching operation of a movable contactor with respect to normally closed and opened stationary contacts.

The small switch of the type referred to is useful when applied to an electric-path switching mechanism based on push-button actuation. For example, such a switch can be applied to an electrical apparatus having a door such that the opening or closing of the door actuates the push-button, whereupon the thereby closed contacts select one of several electric paths incorporated in the apparatus.

DISCLOSURE OF PRIOR ART

One of such small switches of this type has been disclosed in, for example, U.S. Pat. No. 3,187,132 to J. J. Dennison, wherein a push-button is mounted in a switch body. When depressed into the body, the switch causes one end of a pivotably supported lever to be displaced, due to which displacement a projection provided nearly in the center of the lever rocks a movable contactor. The contractor switches from a normally-closed stationary contact to a normally-opened stationary contact respectively provided in the body, and the movable contactor is brought into contact with the normally-opened stationary contact. When the depressing force is released from the push-button, on the other hand, the combined resilient force of the movable contactor itself and a tongue piece integrally provided to the movable contactor for its reversible snapping action reversely shift the movable contactor from the normally-opened stationary contact side to the normally-closed stationary contact side. Hence, the lever and push-button are both returned to their normally-closed positions, and the movable contactor is rapidly brought into contact with the normally-closed stationary contact.

Also disclosed in the above U.S. patent is an arrangement for applying to the push-button a spring load resisting the depressing force. Though not described clearly in the patent, this spring load will be effective, upon an application of a relatively large depressing force due to, for example, an abrupt closing of the door or the like, to absorb such large depressing force to some extent.

Further, in reducing the required number of parts and simplifying the structure of the foregoing small switch in which the reversible snapping action quickly shifts the movable contactor from the normally-opened stationary contact side to the normally-closed stationary contact side as above, it is preferable to make the movable contactor out of a single thin plate of spring material to provide the resilient tongue piece for the snapping action not as a separate member but as a member integral with the movable contactor and raised therefrom.

However, there has arisen such a problem in making the movable contactor out of a thin spring plate that the movable contactor becomes weak and brittle with respect to a high level of stress. More particularly, in such arrangement as in the afore-mentioned U.S. patent wherein the projection of the lever receiving the depressing force of the push-button abuts directly the movable contactor, generally there arises no problem since the normal depressing force applied to the push-button is to be applied relatively gradually to a portion of the movable contactor where the lever projection engages. On the other hand, when the small switch is mounted to an electrical apparatus or the like having a door so that the closing of the door depresses the push-button, an abrupt closing of the door provides a high level of depressing force to the push-button to apply instantaneously a high level of impact to the portion of the movable contactor engaging with the lever projection. This may cause the movable contactor to be easily deformed. Repeated abrupt opening and closing of the door may disadvantageously lead to the deformation or breakage of the movable contactor, thereby disabling the switch.

TECHNICAL FIELD OF THE INVENTION

A primary object of the present invention is, therefore, to provide a small switch which, even when an abrupt depressing operation of a push-button causes a movable contactor to be rocked at a very high speed from a normally-closed stationary contact side to a normally-opened stationary contact side, can attenuate the application rate of the depressing force to prevent the movable contactor from being damaged and thereby prolong its operational life.

According to the present invention, the above object can be realized by providing a small switch which comprises a housing, normally-closed and normally-opened stationary contacts provided in the housing as spaced from one another, and a movable contactor provided as fixed at its base end in the housing and carrying a movable contact at its free end. The movable contact is rocked alternately between the normally closed and opened stationary contacts and has an integral tongue piece cut out of and raised therefrom a free end of the tongue engages the housing, to bias the movable contact to a normally-closed position into contact with the normally-closed stationary contact. A push-button is mounted to the housing for external depression. An inner end of the button is spaced from the movable contactor by a small clearance when the latter is in its normally-closed position in the non-depression state of the push-button a spring applies to the push-button a spring load resistive to the depressing force to maintain the small clearance between the depressing part of the push-button and the movable contactor at the normally-closed position in the non-depression state of the push-button.

In the small switch having such arrangement as above, the presence of the small clearance between the push-button and the movable contactor and the provision of the spring load to the push-button for resisting the depressing force there results, upon application of the abrupt depressing force, an attenuation of the velocity component of the depressing force before the push-button abuts the movable contactor. This serves to lower the impact against the push-button, whereby the movable contactor can be effectively prevented from being deformed or broken.

Other objects and advantages of the present invention shall be made clear in the following description of the invention detailed with reference to preferred embodiments shown in accompanying drawings.

BRIEF EXPLANATION OF THE DRAWINGS

FIG. 1 is a side elevation with a housing shown as vertically sectioned for showing the interior of a small switch in an embodiment according to the present invention;

FIG. 2 is a perspective view as disassembled of a push-button, push-up spring and movable contactor in the switch of FIG. 1;

FIGS. 3*a* to 3*c* are fragmentary diagrams for explaining operational sequence of the push-button, push-up spring and movable contactor in the switch of FIG. 1;

FIG. 4 shows a side view with the housing and push-button shown in section for showing the interior in another embodiment of the small switch according to the present invention;

FIG. 5 is a perspective view as disassembled of a push-button, push-up spring and movable contactor in the switch of FIG. 4; and FIGS. 6*a* to 6*c* are fragmentary diagrams for explaining operational sequence of the push-button, push-up spring and movable contactor in the switch of FIG. 4.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Referring to FIGS. 1 and 2, there is shown a small switch including a housing 10 which comprises a base body 11 and a cover casing 12 mounted on the body 11. Embedded in the body 11 of the housing 10 preferably by insert molding are a normally-opened stationary terminal block 14, a normally-closed stationary terminal block 13 and a common terminal block 15. The legs of the blocks are extended downwardly out of the bottom surface of the body 11 preferably as aligned with each other in a longitudinal direction of the housing 10. Upper parts of the blocks are extended upward in the body 11, into a chamber defined by the body 11 and cover casing 12 to form a normally-closed stationary contactor part 16, a normally-opened stationary contactor part 17 and a common terminal part 18.

Free ends of the stationary contactor parts 16 and 17 are arranged to oppose each other and spaced vertically apart in the present instance, and are fixedly provided at their opposing surfaces with normally-closed and normally-opened stationary contacts 19 and 20, respectively. A movable contactor 21 is fixedly mounted at one base end 21A to the common terminal part 18 by calking or the like means. The movable contactor 21 is made, for example, by being punched out of a thin spring plate. A free end of the spring plate extends into a gap between the stationary contactor parts 16 and 17 and has a movable contact 22 for making alternate contact with the stationary contacts 19 and 20. The movable contactor 21 also has a tongue piece 23 cut and bent to extend down for providing a reversible snap action to the contactor. More specifically, the tongue piece 23 is bent arcuately to be extended toward the common terminal part 18 so that its free end is engageable with a projection 25 erected upright from the body 11. That projection is located within a tongue-cut window 24 of the movable contactor 21 at an intermediate position in the longitudinal direction of the contactor.

The cover casing 12 of the housing 10 is provided with a duct part 27 including an aperture 26 for receiving a push-button 28 having an upper or outer operating head part 29 integral with a lower or inner depressing part 30. The operating head part 29 is extended at its top out of the housing 10, while the depressing part 30 is disposed within the housing to oppose at its bottom end the movable contactor 21. The part 30 is spaced from the contractor 21 by a small clearance H when the contactor 21 is at its normally-closed position where the movable contact 22 is in contact with the normally-closed stationary contact 19. The bottom end of the depressing part 30 of the push-button 28 is formed to have two notches 31 (only one of which is seen in the drawings). Each notch 31 is made to have an arcuate upper edge 32, so that free ends of a pair of forked biasing arms 34 and 34*a* of a push-up spring 33 extended obliquely upwardly on the side of the movable contact 22 are resiliently received in the notches 31. The push-up spring 33 is superimposed over the upper side of the movable contactor 21. Base ends 33A of the push-up spring 33 and movable contactor 21 are fixedly mounted to the top of the common terminal part 18. The push-up spring 33 is curved to define biasing arms 34, 34*a* of generally S-shaped as seen from the side. The arms 34, 34*a* are rounded at their free ends so as to be smoothly slidable along the arcuate upper edges 32 of the notches 31. Intermediate curved portions 35 and 35*a* of the arms, located between the free ends and the base ends are convex downwardly so as to be resiliently engageable with the movable contactor 21. With such arrangement as shown in FIG. 1 in which the movable contactor 21 is positioned at the normally-closed position of contacting the normally-closed stationary contact 19, the depressing part 30 of the push-button 28 is pushed up by the free ends of the arms 34 and 34*a* of the push-up spring 33. As long as no external depressing force is applied, the push-button 28 stays in the uppermost position and the clearance H between the movable contactor 21 and the depressing part 30 of the push-button 28 is maintained. In this state, further, the downward curved portions 35 and 35*a* of the push-up spring 33 are positioned closer to the movable contactor 21 than the bottom end of the depressing part 30.

Thus, each biasing arm 34 comprises a first portion 35A extending from the base part 33A in spaced relation to the movable contactor, a second portion 35 extending toward the movable contactor, and a third portion 35B extending toward the inner end of the button 28. The third portion 35B terminates in a free end 35C of the biasing arm 34.

The operation of the above described embodiment of the small switch according to the present invention shall be explained. When an external depressing force is applied to the push-button 28 from the exterior of the housing 10, the push-button 28 shifts from its uppermost position and gradually approaches the movable contactor 21 against the resilient force of the push-up spring 33, as shown in FIG. 3*b*. The downward curved portions 35 and 35*a* of the arms 34 and 34*a* of the push-up spring 33 (which are closer to the movable contactor 21 than the depressing part 30 of the push-button 28, defined abutment portions which are caused to approach and engage the contactor 21 earlier than the depressing part, during a first stage of depression in which the push-button 28 is subjected to a spring force of the entire length of the biasing arms 34, 34*a* from the base end 33A to the free end 35C. After the abutment portion 35 engages the movable contactor, further depression of the button during a second stage is resisted by an additional spring force due to the deflection of a much shorter part of the biasing arm extending between the curved portions 35, 35*a* and the free ends 35C. In other words, a relatively larger return biasing force than that of the entire arms 34 and 34*a* is imposed on the push-button 28 after the curved abutment portions 35 and 35*a* abut the movable contactor 21. As the push-button 28 is further depressed against this relatively large biasing force of the arms 34 and 34*a* until the depressing part 30 abuts at its bottom end the movable contactor 21, as shown in FIG. 3*c*, the small clearance between the bottom end of the depressing part 30 and the movable contactor 21 is completely lost.

When the push-button 28 is further depressed against the resilient forces of the movable contactor 21 itself and its tongue piece 23 now additionally applied, the movable contactor 21 is caused to rock from the normally-closed stationary contact 19 side to the normally-opened stationary contact 20 side, so that the movable contact 22 is separated from the normally closed stationary contact 19. The movable contactor 21 rocks toward the normally-opened stationary contact side until the movable contactor 21 exceeds a reverse limit position in the reversible snapping operation of the tongue piece 23, the movable contactor 21 is quickly turned back to the position of contacting the movable contact 22 with the normally-opened stationary contact 20. That is, in the illustrated embodiment, the reversible snapping action enables instantaneous separation and engagement of the movable contact 22 from the normally-closed stationary contact 19 and with the normally-opened stationary contact 20 to be realized. When the depressing force to the push-button 28 is released, on the other hand, the combined resilient forces of the movable contactor 21 itself, the tongue piece 23 and push-up spring 33 are activated simultaneously so that the movable contactor 21 is separated from the normally-opened stationary contact 20 to return into the contact with the normally-closed stationary contact 19, with the push-button 28 returned to the uppermost position in the duct part 27 of the housing 10, and the clearance H is restored between the movable contactor 21 and the depressing part 30 of the push-button 28.

In the switch of FIG. 1 described above, the bottom end of the depressing part 30 is spaced from the movable contactor 21 particularly in the beginning of the depression of the push-button 28. Thus, even when any abrupt depressing force is applied to the push-button 28 due to, for example, a rough door closing in the electrical apparatus, the resilient force of the entire length of the push-up spring 33 and then the relatively larger resilient force of the arm portions 34 and 34*a* between the curved portions 35, 35*a* and the free ends 35*c* made effective at the moment of the engagement of the curved portions 35, 35*a* with the movable contactor 21 are sequentially acted against the abrupt depressing force before the depressing part 30 abuts the movable contactor 21 as shown in FIG. 3*c*. It will be appreciated that these resilient forces produce a remarkable attenuation of the velocity component of the depressing force applied to the push-button 28 prior to the engagement of the depressing part 30 of the push-button 28 with the movable contactor 21, and thus a remarkable reduction of impact energy applied to the movable contactor 21 after the engagement of the depressing part 30 with the movable contactor 21. Accordingly, even when any abrupt depressing force is applied to the push-button 28, the deformation and breakage of the movable contactor 21 can be effectively prevented. In an event where, for example, the engaging position of the depressing part 30 of the push-button 28 with the movable contactor 21 is set to be closer than the portion 35 to the base end of the movable contactor 21 than, an application of a large impact to the movable contactor 21 may cause the contactor 21 to be easily broken in the vicinity of its securing portion of the base end. However, the movable contactor 21 can be effectively prevented from being involved in such trouble, according to the present invention.

Further, the push-up spring 33 mounted together with the movable contactor 21 can also act as a heat-radiating fin when subjected to heat from the contactor 21 to reduce heat generated between the movable contact 22 and the both stationary contacts 19 and 20, so as to be contributive to a suppression of temperature rise in the contact zone.

Referring to FIGS. 4 and 5, there is shown another embodiment of the present invention, in which substantially the same constituent members as those in the embodiment in FIGS. 1 and 2 are denoted by the same reference numerals but added by 100. This embodiment is different from the foregoing embodiment mainly in that a push-up spring 133 is modified and correspondingly a push-button 128 is changed in the forming position of spring receiving notch 131.

More specifically, in the present embodiment, the base end 133A, first portion 135A, and second portion 135 of the push-up spring 133 are positioned underlie a movable contactor 121 in superimposed relation thereto. The spring has a single resilient arm 134, a third portion 135B of which extends obliquely upward, through a window 124 of the movable contactor 121 to engage in the spring receiving notch 131 formed in the center of the bottom end of the depressing part 130 of the push-button 128. The notch 131 has an upper arcuate edge 132, and the free end 135C of the arm portion 134 is inwardly bent and rounded so as to smoothly slide along the arcuate upper edge 132. The second portion 135 of the arm 134 is arranged for abutment with the underside of the movable contactor 121 in the absence of any depressing force to the push-button 128.

In operation, a depressing force applied to the push-button 128 from the exterior of a housing 110 causes the push-button 128 to be shifted from a non-depression position as shown in FIG. 6*a* in which the small clearance H exists between the movable contactor 121 and the depressing part 130, to a position as shown in FIG. 6*b* in which the push-button 128 comes closer to the movable contactor 121 against the resilient force of the push-up spring 133, and finally to such a position as shown in FIG. 6*c* in which the depressing part 130 abuts at its bottom end the movable contactor 121 to completely eliminate the clearance between the bottom end of the depressing part 130 and the movable contactor 121. Further depression of the push-button 128 causes the movable contactor 121 to be rocked so that the movable contact 122 contacts a normally-opened stationary contact 120, whereby the electrical path is switched from the normally-closed contact side to the normally-opened contact side, as in the foregoing embodiment.

Unlike the foregoing embodiment, the spring force of the push-up spring 133 is not varied during the depression of the push-button 128 in the present embodiment, but a force resistive to the depressing force to the push-button 128 can be increased by properly increasing the resiliency of the spring 133, so as to provide the movable contactor 121 with a sufficient resistivity to the abrupt depressing impact through the push-button 128, for effective prevention of the movable contactor 121 from being thereby damaged.

When the depressing force to the push-button 128 is released, on the other hand, the combined resilient forces of the movable contactor 121, tongue piece 123 and push-up spring 133 are simultaneously activated to reversely snap the movable contact 122. The abutment portion 135 provided in the arm 134 of the push-up spring 133 acts to push up the movable contactor 121 by abuting the contactor 121 from its underside so that, even when the movable contact 122 and normally-opened stationary contact 120 are fused together, the movable contact 122 can be separated from the stationary contact 120, as will be readily understood.

Other arrangement and operation of the embodiment of FIGS. 4 and 5 are substantially the same as those of the foregoing embodiment of FIGS. 1 and 2.

What is claimed as our invention is:

1. An electrical switch comprising:

a housing, first and second stationary terminals including first and second stationary terminal parts, respectively, disposed in said housing, a normally-closed stationary contact and a normally-open stationary contact disposed in said housing and fixed to said first and second terminal parts, respectively, a third terminal including a third stationary terminal part disposed in said housing, a movable contactor disposed in said housing and including a base end and a free end, said base end being fixed to said third terminal part, said free end carrying movable contact means, said movable contactor being rockable to move said movable contact means alternately into engagement with said normally-closed and normally-open contacts, said movable contactor including an integral tongue having a free end engageable with a portion of said housing so as to normally urge said movable contactor into a normal position engaging said movable contact means with said normally-closed contact, a push-button movably mounted on said housing and including outer and inner ends, said outer end being accessible from outside of said housing so as to be manually depressible for causing said inner end of said button to be moved inwardly, said inner end of said button positioned to face said movable contactor, and including a notch opening toward said movable contactor, and a spring disposed in said housing for yieldably biasing said button in its non-depressed position such that a clearance is normally maintained between said inner end of said button and said movable contactor, said spring including a base end connected to said third terminal part and lying flush against said base end of said movable contactor, said spring disposed in superimposed relation to said movable contactor, and including a biasing section comprising:

a first portion extending from said base part in spaced relation to said movable contactor, a second portion extending toward said movable contactor and comprising a bent abutment portion normally spaced from said movable contactor by a distance less than said clearance and arranged to engage said movable contactor prior to engagement of said movable contactor by said inner end of said button when said button is depressed, whereby upon depression of said button said spring initially deforms about its base end and opposes depression of said button by a first force prior to engagement of said abutment portion with said movable contactor and thereafter said free end deforms about said abutment portion to oppose depression of said button by a second, larger force, and a third portion extending away from said movable contactor and terminating in a free end of said spring, said free end being received in said notch of said button for sliding movement along a surface thereof.

2. A switch according to claim 1, wherein said spring is entirely disposed on a side of said movable contactor facing said button.

3. A switch according to claim 1, wherein said spring includes two said biasing sections spaced apart and disposed parallel to one another, said inner end of said buttom including two said notches for receiving said free end of each said biasing section.

4. A switch according to claim 1, wherein said surface of said notch is arcuate.

5. A switch according to claim 4, wherein said free end of said spring is rounded.

6. An electrical switch comprising:

a housing, first and second stationary terminals including first and second stationary terminal parts, respectively, disposed in said housing, a normally-closed stationary contact and a normally-open stationary contact disposed in said housing and fixed to said first and second terminal parts, respectively, a third terminal including a third stationary terminal part disposed in said housing, a movable contactor disposed in said housing and including a base end and a free end, said base end being fixed to said third terminal part, said free end carrying movable contact means, said movable contactor being rockable to move said movable contact means alternately into engagement with said normally-closed and normally-open contacts, said movable contactor including an integral tongue having a free end engageable with a portion of said housing so as to normally urge said movable contactor into a position engaging said movable contact means with said normally-closed contact, a push-button movably mounted on said housing and including outer and inner ends, said outer end being accessible from outside of said housing so as to be manually depressible for causing said inner end of said button to be moved inwardly, said inner end of said button positioned to face said movable contactor, and a spring disposed in said housing for yieldably biasing said button to its non-depressed position such that a clearance is normally maintained between said inner end of said button and said movable contactor, said spring including a base end anchored in said housing, a button-engaging portion engaging said button, and an abutment portion normally spaced from said movable contactor by a distance less than said clearance and arranged to engage said movable contactor prior to engagement of said movable contactor by said inner end of said button when said button is depressed, whereby upon depression of said button said spring initially deforms about its base end and opposes depression of said button by a first force prior to engagement of said abutment portion with said movable contactor and thereafter said free end deforms about said abutment portion to oppose depression of said button by a second, larger force.

7. An electrical switch comprising:

a housing, first and second stationary terminals including first and second stationary terminal parts, respectively, disposed in said housing, a normally-closed stationary contact and a normally-open stationary contact disposed in said housing and fixed to said first and second terminal parts, respectively, a third terminal including a third stationary terminal part disposed in said housing, a movable contactor disposed in said housing and including a base end and a free end, said base end being fixed to said third terminal part, said free end carrying movable contact means, said movable contactor being rockable to move said movable contact means alternately into engagement with said normally-closed and normally-open contacts, said movable contactor including an integral tongue having a free end engageable with a portion of said housing so as to normally urge said movable contactor into a normal position engaging said movable contact means with said normally-closed contact, a push-button movably mounted on said housing and including outer and inner ends, said outer end being accessible from outside of said housing so as to be manually depressible for causing said inner end of said button to be moved inwardly, said inner end of said button positioned to face said movable contactor, and including a notch opening toward said movable contactor, and a spring disposed in said housing for yieldably biasing said button in its non-depressed position such that a clearance is normally maintained between said inner end of said button and said movable contactor, said spring including a base end connected to said third terminal part and lying flush against said base end of said movable contactor, said spring disposed in superimposed relation to said movable contactor, and including a biasing section comprising:

a first portion extending from said base part in spaced relation to said movable contactor, a second portion extending toward said movable contactor, and a third portion extending away from said movable contactor and terminating in a free end of said spring, said free end being received in said notch of said button for sliding movement along a surface thereof, a portion of said spring underlying said movable contactor so as to be engageable with a side of the latter facing away from said button for urging said movable contactor to its normal position in which said movable contact means engages said normally closed contact when said button is in its non-depressed condition.

8. A switch according to claim 7, wherein said portion of said spring which underlies said movable contactor comprises said base end, said first portion, and said second portion; said third portion projecting toward said inner end of said button through an opening in said movable contactor.

9. An electrical switch comprising:

a housing, first and second stationary terminals including first and second stationary terminal parts, respectively, disposed in said housing, a normally-closed stationary contact and a normally-open stationary contact disposed in said housing and fixed to said first and second terminal parts, respectively, a third terminal including a third stationary terminal part disposed in said housing, a movable contactor disposed in said housing and including a base end and a free end, said base end being fixed to said third terminal part, said free end carrying movable contact means, said movable contactor being rockable to move said movable contact means alternately into engagement with said normally-closed and normally-open contacts, said movable contactor including a integral tongue having a free end engageable with a portion of said housing so as to normally urge said movable contactor into a position engaging said movable contact means with said normally-closed contact, a push-button movably mounted on said housing and including outer and inner ends, said outer end being accessible from outside of said housing so as to be manually depressible for causing said inner end of said button to be moved inwardly, said inner end of said button positioned to face said movable contactor, and a spring disposed in said housing for yieldably biasing said button to its non-depressed position such that a clearance is normally maintained between said inner end of said button and said movable contactor, said spring including a base end anchored in said housing, a button-engaging portion, and an abutment portion underlying said movable contactor so as to be engageable with a side of the latter facing away from said button for urging said movable contactor to its normal position in which said movable contact means engages said normally closed contact when said button is in its non-depressed condition.

* * * * *